US009868627B2

(12) United States Patent
Batistakis

(10) Patent No.: US 9,868,627 B2
(45) Date of Patent: Jan. 16, 2018

(54) COMBINATION SPOUT AND FILTER, PARTICULARLY FOR PAINT BARRELS

(71) Applicant: Paul Batistakis, Toronto (CA)

(72) Inventor: Paul Batistakis, Toronto (CA)

(73) Assignee: Paul Batistakis, Toronto (CA)

( * ) Notice: Subject to any disclaimer, the term of this patent is extended or adjusted under 35 U.S.C. 154(b) by 116 days.

(21) Appl. No.: 14/625,731

(22) Filed: Feb. 19, 2015

(65) Prior Publication Data

US 2016/0244317 A1 Aug. 25, 2016

(51) Int. Cl.
*B67D 7/76* (2010.01)
*B67D 7/00* (2010.01)
*B65D 25/48* (2006.01)

(52) U.S. Cl.
CPC ..... *B67D 7/76* (2013.01); *B65D 25/48* (2013.01); *B67D 7/005* (2013.01)

(58) Field of Classification Search
CPC ..... B67D 7/76; B67D 7/005; B65D 47/06
USPC ..... 222/189.07, 566; 210/787, 454, 435; 215/298, 305
See application file for complete search history.

(56) References Cited

U.S. PATENT DOCUMENTS 242,962 A * 6/1881 Newton ..... A47J 31/14 220/88.2
343,908 A * 6/1886 Lagerquist ..... B65D 25/42 222/566
497,312 A * 5/1893 Ditton ..... A01C 23/042 210/454
513,893 A * 1/1894 Davenport ..... A47J 31/14 210/463
569,188 A * 10/1896 Gaddes ..... B65D 25/48 210/466
596,369 A * 12/1897 Jackson ..... A47J 31/14 210/466
767,471 A * 8/1904 Barnett ..... A47J 36/08 210/466
852,584 A * 5/1907 Skinner ..... B01D 35/30 210/310
1,140,720 A * 5/1915 Simons ..... B01D 35/30 210/312
1,594,640 A * 8/1926 Spindler ..... A47J 31/14 222/189.07
1,641,051 A * 8/1927 Rheney ..... B65D 25/42 210/244
1,959,584 A * 5/1934 Hurley ..... B65D 25/48 210/466
1,987,055 A * 1/1935 Dival ..... B65D 47/127 222/545
2,243,636 A * 5/1941 Kraetch ..... B65D 47/06 222/545

(Continued)

*Primary Examiner* — Nicholas J Weiss
*Assistant Examiner* — Michael J Melaragno
(74) *Attorney, Agent, or Firm* — McMillan LLP

(57) ABSTRACT

A combined filter and spout device for use with a paint barrel includes a hollow body having a pouring end, a straining end and a barrel opening engaging portion therebetween; the engaging portion sized and otherwise dimensioned to be friction fit into the liquid dispensing opening of the barrel; the pouring end having a shape which facilitates the outflow of liquid from the barrel; and the straining end having a convex surface enclosing the hollow body; the convex surface having a plurality of perforations sized and otherwise dimensioned to permit liquid to pass therethrough.

14 Claims, 3 Drawing Sheets

(56) References Cited

U.S. PATENT DOCUMENTS 2,274,752 A * 3/1942 Straub ..... B65D 47/121 222/545
2,471,189 A * 5/1949 Bartels ..... B65D 25/48 222/189.07
2,606,694 A * 8/1952 Galletta ..... B44D 3/10 220/711
2,645,382 A * 7/1953 Plough ..... A47F 1/03 210/239
2,753,051 A * 7/1956 Tupper ..... B65D 47/148 210/239
3,081,912 A * 3/1963 Goceliak ..... B65D 25/48 210/474
3,590,416 A * 7/1971 Henningsen ..... B44D 3/126 15/257.06
4,025,435 A * 5/1977 Shea ..... B44D 3/10 210/250
4,066,557 A * 1/1978 Banoczi ..... B01D 33/01 210/359
4,240,568 A * 12/1980 Pool ..... B44D 3/121 220/698
4,299,340 A * 11/1981 Hrytzak ..... B65D 25/48 222/189.07
4,555,339 A * 11/1985 Graves ..... A47J 43/28 210/244
4,595,130 A * 6/1986 Berney ..... B65D 47/061 222/189.06
4,736,874 A * 4/1988 Durant ..... B65D 25/48 220/698
4,764,274 A * 8/1988 Miller ..... C02F 1/003 210/232
5,031,804 A * 7/1991 Conrad ..... B65D 25/48 222/566
RE33,723 E * 10/1991 Hartley ..... B01D 29/27 210/448
5,059,319 A * 10/1991 Welsh ..... B01D 29/01 210/232
5,065,913 A * 11/1991 Glasener ..... B67C 11/02 222/1
5,137,554 A * 8/1992 Carter, Jr. ..... A47L 9/1608 55/399
5,186,828 A * 2/1993 Mankin ..... B01D 29/27 210/232
5,221,475 A * 6/1993 Mealey ..... B01D 29/085 210/474
5,368,728 A * 11/1994 Reaves ..... B01D 29/27 210/232
5,490,927 A * 2/1996 Herczeg ..... B01D 61/18 210/321.75
5,611,377 A * 3/1997 Maguire ..... B01D 41/04 141/106
5,681,463 A * 10/1997 Shimizu ..... B01D 61/18 210/266
5,743,358 A * 4/1998 Bedi ..... B01D 35/306 123/196 R
5,935,435 A * 8/1999 Hasler ..... B01D 29/085 210/232
6,149,808 A * 11/2000 Johnson ..... B01D 35/05 210/242.1
6,283,318 B1 * 9/2001 Lee ..... B65D 41/485 215/254
6,345,721 B1 * 2/2002 Durre ..... B01D 27/005 210/440
6,387,261 B1 * 5/2002 Mojena ..... B01D 24/008 210/315
6,436,286 B1 * 8/2002 Scott ..... B01D 29/27 210/232
6,685,843 B2 * 2/2004 Leaverton ..... B01D 29/27 210/167.12
6,983,869 B1 * 1/2006 Stevens ..... B65D 47/127 220/701
7,832,567 B2 * 11/2010 Joseph ..... B01D 29/15 210/464
8,459,468 B2 * 6/2013 Lin ..... A47J 31/18 210/464
8,808,552 B2 * 8/2014 Lin ..... B01D 29/085 210/232
2002/0000451 A1 * 1/2002 Hansen ..... B67D 7/0294 222/189.1
2004/0164182 A1 * 8/2004 Joseph ..... B05B 7/2408 239/345
2006/0081652 A1 * 4/2006 Press ..... B65D 47/06 222/189.06
2006/0091065 A1 * 5/2006 Godfrey ..... B01D 29/085 210/466
2007/0235381 A1 * 10/2007 Tsai ..... C02F 1/003
2008/0041240 A1 * 2/2008 Tarantino ..... C12G 1/04 99/495
2008/0282908 A1 * 11/2008 Cole ..... A23L 2/70 99/495
2010/0195432 A1 * 8/2010 Laurence ..... B44D 3/127 366/139
2012/0074049 A1 * 3/2012 Petersen ..... B01D 46/0002 210/167.08
2012/0228331 A1 * 9/2012 MacDonald ..... B65D 25/48 222/189.07
2012/0267314 A1 * 10/2012 Minton-Edison ..... C02F 1/002 210/695
2012/0325735 A1 * 12/2012 Dicks ..... C02F 1/002 210/289
2012/0325858 A1 * 12/2012 MacDonald ..... B65D 25/48 222/189.07
2013/0042585 A1 * 2/2013 Mei ..... B01D 46/0001 55/308
2013/0233890 A1 * 9/2013 Melzer ..... C02F 1/003 222/189.06
2013/0248536 A1 * 9/2013 Prum ..... A47J 43/00 220/568
2014/0013966 A1 * 1/2014 Olucha Soler ..... A47J 19/02 99/501
2014/0061110 A1 * 3/2014 Hawkins ..... B01D 36/005 210/232
2014/0069871 A1 * 3/2014 Brown ..... B01D 29/111 210/663
2014/0263020 A1 * 9/2014 MacDonald ..... C02F 1/003 210/232
2014/0263466 A1 * 9/2014 Gringer ..... B65D 47/06 222/367
2014/0291235 A1 * 10/2014 Schmitz ..... B01D 29/111 210/435
2015/0209706 A1 * 7/2015 McCary, Sr. ..... C02F 1/002 604/514
2015/0232233 A1 * 8/2015 Kent ..... B44D 3/12 222/570
2015/0352473 A1 * 12/2015 Marconi ..... C02F 1/002 210/450

* cited by examiner

SECTION A-A
SCALE 1 : 1

COMBINATION SPOUT AND FILTER, PARTICULARLY FOR PAINT BARRELS

FIELD OF THE INVENTION

The invention relates generally to the field of accessories for liquid barrels, such as paint barrels, and more particularly to a combination spout and filter for use with a paint, or other liquid, barrel.

BACKGROUND OF THE INVENTION

Conventional paint barrels have long been troublesome to painters, particularly commercial paint barrels such as the standard five gallon barrel typically sold. Paint barrels are normally filled to the brim in such a manner that pouring paint out of these barrels without a spout is difficult. Prior art spouts do exist, but are often difficult to connect to a paint barrel, which either has a threaded cover over a paint outlet or a plugged hole from which paint is poured with the plug removed. In addition, particles within larger paint barrels have to be removed before the paint is used, or great care has to be taken to ensure that such particles are not picked up by paint brushes thus again inconveniencing the painters. Various filters for paint barrels are also known in the prior art.

Combined spout and filter devices are also known in the art, for example, those produced by Kovrd Products Inc. and described in their United States Patent Publication Nos. 2012/0325858 and 2012/0228331. These products include a spout with a fabric or mesh type material connected to a bottom portion of the spout and extending into the paint barrel which prevents the flow of particles into the spout. However, some problems still exist with the Kovrd Products spout. In particular, the interface between the spout and filter may be prone to failure and the flow rate of paint out of the container is reduced.

One example of these particles are lumps and clumps of paint found in the barrels. Plastic barrels are oxygen permeable. Air can enter the barrel causing an inner lining of skin on the walls of the pail, resulting from variations in air temperature. When pouring paint out of the barrel, this skin begins to peel away and enter the paint.

It would thus be beneficial to provide an improved device capable of acting as a filter and a spout having a longer lifespan than the prior art and optionally avoiding the decreased flow rate problem.

SUMMARY OF THE INVENTION

According to one embodiment of the invention, there is provided combined filter and spout device for use with a barrel having a liquid dispensing opening having a hollow body having a pouring end, a straining end and a barrel opening engaging portion therebetween; the engaging portion sized and otherwise dimensioned to be friction fit into the liquid dispensing opening of the barrel; the pouring end having a shape which facilitates the outflow of liquid from the barrel; and the straining end having a convex surface enclosing the hollow body; the convex surface having a plurality of perforations sized and otherwise dimensioned to permit liquid to pass therethrough.

In one aspect of the invention, the device further includes a plurality of perforations on the hollow body proximate the straining end.

In another aspect of the invention, proximate the straining end refers to a distance equivalent to the distance from a bottom end straining end to an apex of the convex surface.

In another aspect of the invention, the hollow body comprises a twisted shape between the engaging portion and the straining end.

In another aspect of the invention, the twisted shape includes between 0.5 and 2 revolutions.

In another aspect of the invention, the device further includes a plurality of perforations on a bottom portion of one of the revolutions proximate the straining end.

In another aspect of the invention, the pouring end has a diameter greater than a diameter of the engaging portion.

In another aspect of the invention, the pouring end includes a spouted portion having a central axis positioned angularly to a central axis of the engaging portion, whereby the spouted portion is angled with respect to the engaging portion.

In another aspect of the invention, the pouring end further comprises a gripping hole formed at a portion of the pouring end distal from the spouted portion; the gripping hole configured to receive a human finger such that the device can be compressed for removal from or insertion into the barrel.

In another aspect of the invention, the device further includes a guard portion extending from an interior surface of the hollow body to a position proximate a top surface of the pouring end surrounding the gripping hole; the guard portion preventing liquid from contacting the gripping hole when liquid is being poured out of the barrel.

In another aspect of the invention, the guard portion consists of a convex extrusion extending from the interior surface of the hollow body proximate the engaging portion and extending at an angle to the interior surface.

In another aspect of the invention, the liquid is paint.

In another aspect of the invention, the barrel is a five galleon paint barrel.

In another aspect of the invention, the device is formed from a semi-flexible material.

In a second embodiment of the invention, there is provided a paint barrel having a main body portion for holding paint, a paint outlet on a lid of the barrel; and, a combined filter and spout device as herein described.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
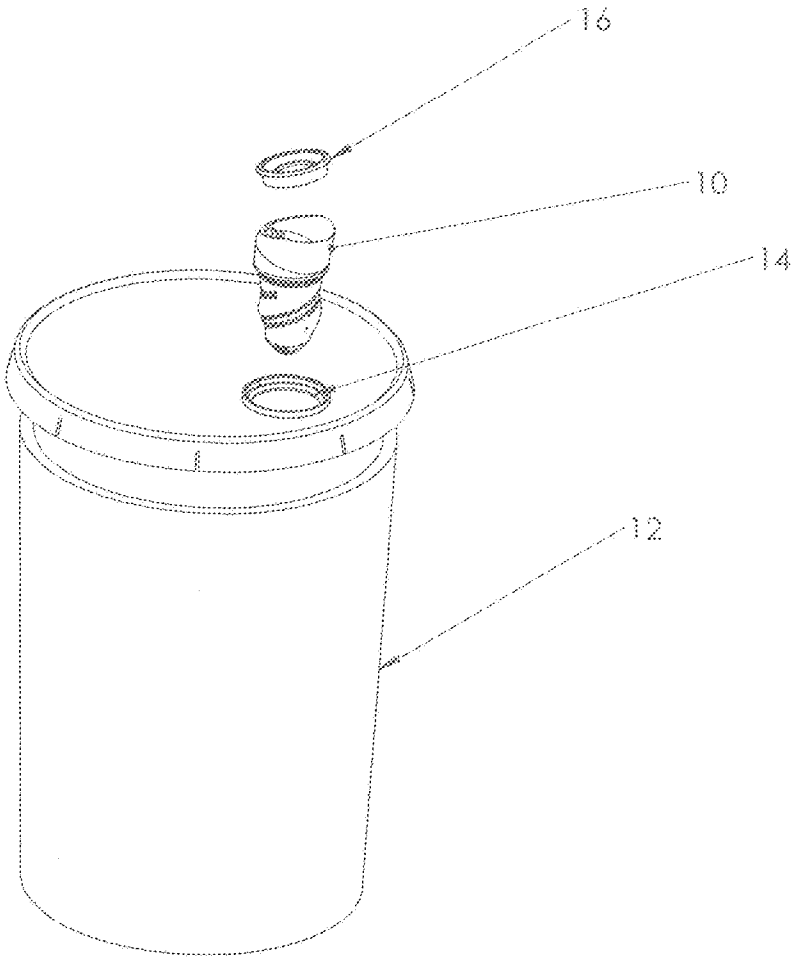
FIG. 1 is an assembly drawing of a combined filter and spout device of the invention in use with a paint barrel.
Figure 3:
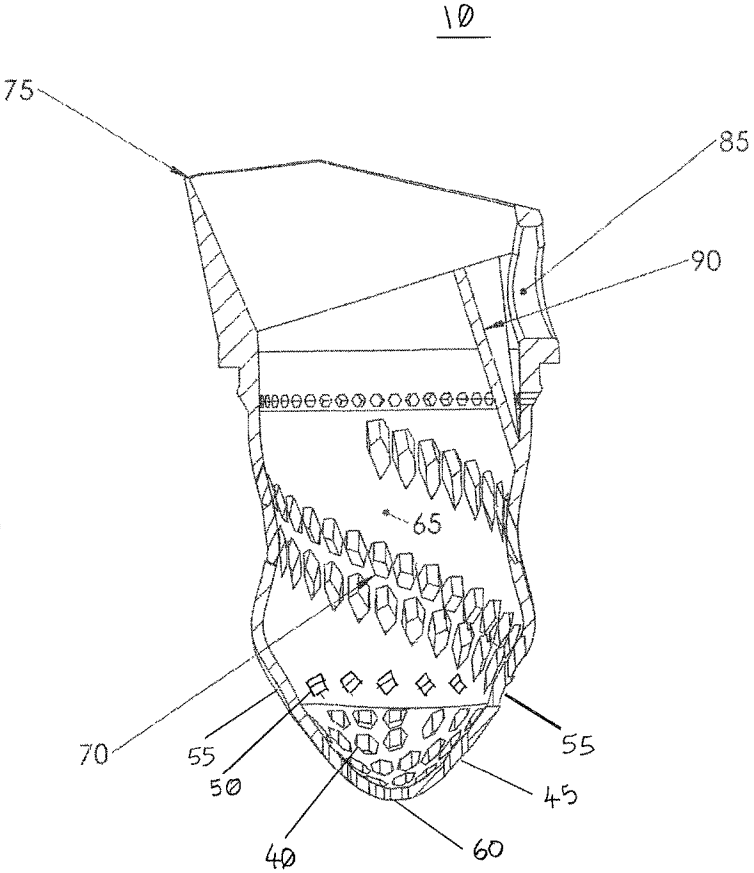
FIG. 3 is a sectional view taken along line A-A in FIG. 2.
Figure 2:
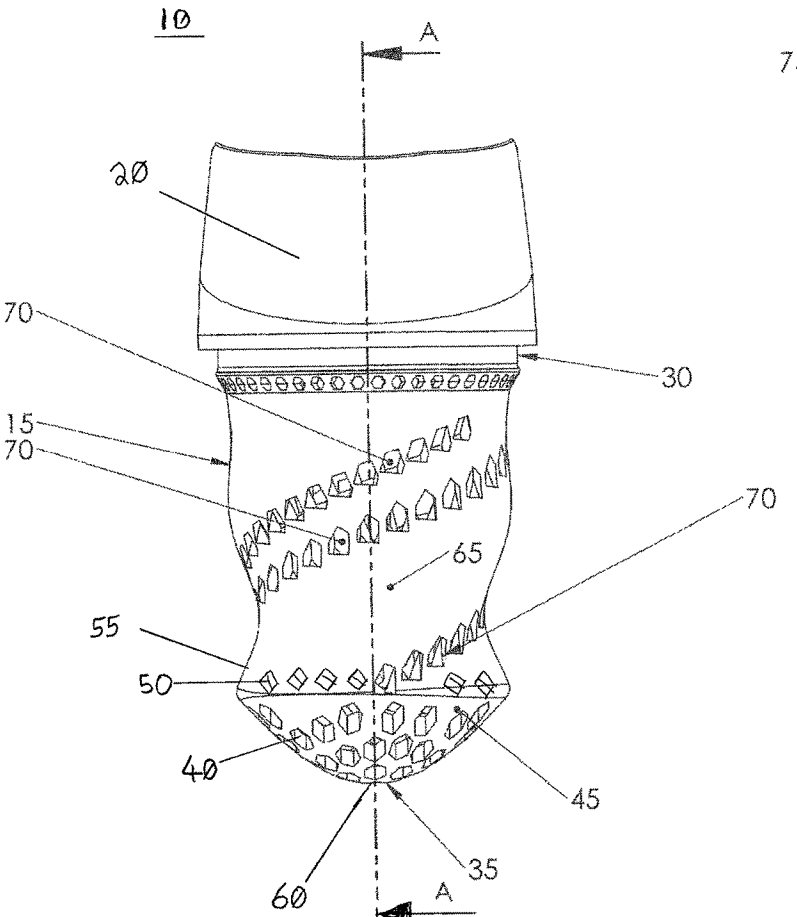
FIG. 2 is a front view of the combined filter and spout device according to one embodiment of the invention.
Figure 4:
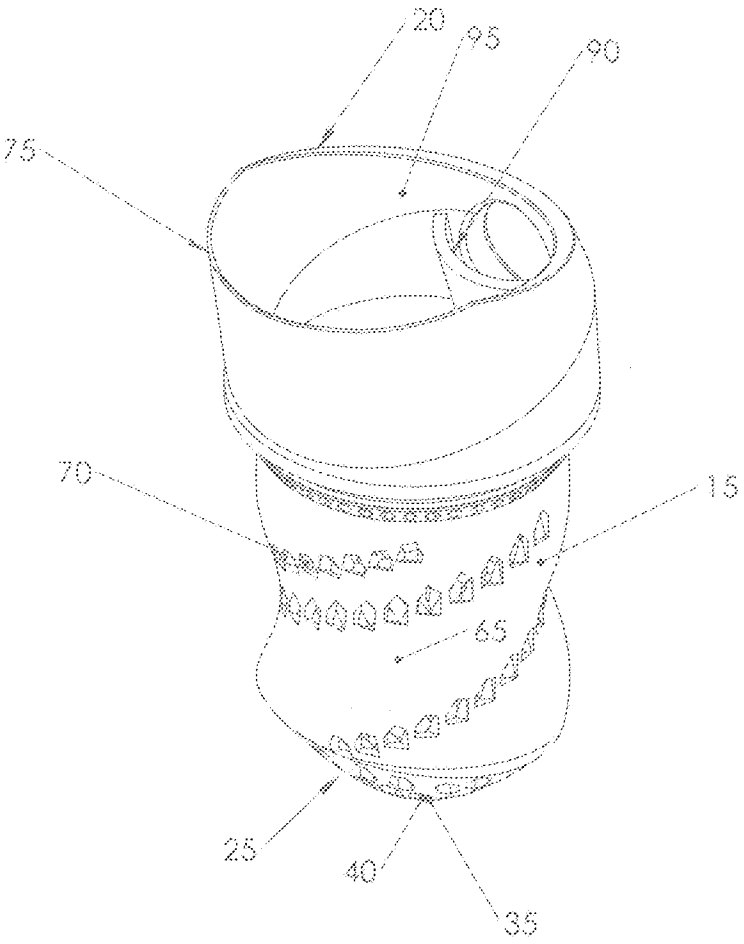
FIG. 4 is a perspective view of the device shown in FIG. 2.
Figure 5:
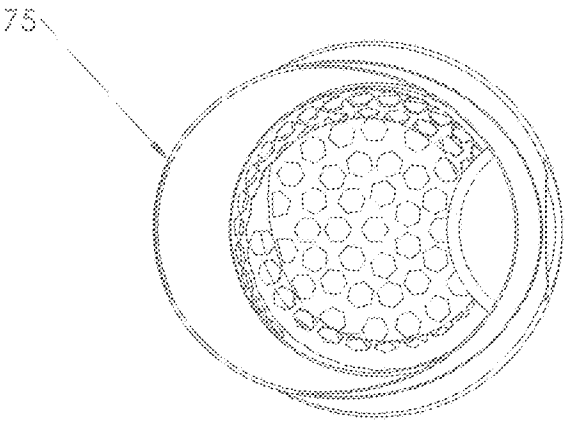
FIG. 5 is a top view of the device shown in FIG. 2.

Turning now to FIG. 1, there is shown one embodiment of the invention in which a combined filter and spout device 10 for use with a paint barrel 12 having a paint dispensing opening 14 is illustrated. The combined device 10 is preferably molded (or otherwise produced) as a unitary form, and from a semi-flexible material such as a thermoplastic polymer such that the combined device 10 can be friction fit into a standard sized opening in a paint barrel (not shown), whether threaded or not, while providing a seal at the interface with the paint barrel.

Additional details of the combined filter and spout device 10 are shown in FIGS. 2-5 and generally include a hollow body portion 15 having a pouring end 20, a straining end 25 and a paint barrel engaging portion 30 between the pouring end 20 and the straining end 25. The paint barrel engaging portion 30 is sized, and otherwise dimensioned to be friction fit into the paint barrel (not shown). The friction fit will be a function of the semi-flexible material selected depending on particular implementations, which can be compressed for insertion into the paint barrel opening, and released once in a position to secure the device 10 in place. The pouring end 20 has features of shape and design which facilitate the outflow of liquid from the barrel, and will be described in more detail below.

The straining end 25 includes a porous area, preferably produced by forming a plurality of perforations on an otherwise enclosed bottom surface 35 of the device 10. In the preferred embodiment, the bottom surface 35 has a convex surface 45 which encloses the hollow body 15, with a plurality of perforations 40 formed on the convex surface 45. A bottom portion 55 of the hollow body portion 15 is defined at a position at which the convex surface 45 extends from the hollow body 15. The perforations 40 may be positioned at any location on the convex surface 45. In addition, additional perforations 50 may be provided on the bottom portion 55 proximate the convex surface 45. Providing the perforations 40 on the convex surface 45 improves upon the flow rate out of the straining end of the device 10 by providing all or a substantial portion of the straining to occur from a bottom surface of the device 10. The additional perforations 50 facilitate straining of paint at the bottom portion of the device 10, but outside of the convex surface 45. Generally, the additional perforations 50 will be provided within a distance from the bottom surface 35 to the apex 60 of the convex surface 45. This distance will also approximately be equal to the height of the bottom portion 55.

Optionally, the hollow body 15 is formed from a twisted shape 65 consisting of one or more surface revolutions between the engaging portion 30 and the straining end 25. Preferably, the twisted shape consists of 0.5 to 2 revolution, and more preferably between 1 and 1.5 surface revolutions. The twisted shape, which includes these surface revolutions acts to induce a cyclone effect when pouring liquid out of the container, thus increasing the flow rate. In addition, it makes possible to use of sidewall perforations 70 traversing at least a portion of each of the surface revolutions. This further facilitates the cyclone effect by permitting entry of liquid into the hollow body portion 15, while still allowing the straining function. In some embodiments, the sidewall perforations 70 are provided proximate the bottom portion 55 of the device 10 only, but it is preferable that the sidewall perforations 70 follow the surface revolutions. The number of perforations may vary dependent on the size of each perforation, however, one skilled in the art will appreciate that the perforations are sized, and otherwise dimensioned, to provide the straining functionality and prevent solid particles from being poured out of the container 12.

Furthermore, the arrangement of perforations along the surface revolutions minimizes, or altogether eliminates, the effects of blockages due to abnormally large solid particles, which could occur should all the perforations or straining holes be located in a single region. The resultant cyclone effect may also serve to dislodge any solid particles blocking some of the perforations, for example those on the convex surface 45 or those on other areas of the surface revolutions.

Other arrangements and orientations of the perforations are also contemplated. For example, the entirety of the hollow body portion 15 may be perforated to provide the straining capabilities along the entirety of the sidewall, although this may mitigate some of the cyclone effects which provide a higher flow rate, for those applications where a higher flow rate is not of prime importance.

Turning back now to other features of the device 10, the pouring end 20 optimally has a diameter greater than a diameter of the engaging portion 30. This facilitates placement of the device 10 atop the opening 14 in the barrel 12. This is particularly advantageous in barrels having a threaded opening for receiving a threaded closure cap or threaded pouring adaptor, where the difference in diameters couples with the flexible material used in the device 10 facilitates proper positioning of the device 10 to ensure leak-free pouring.

The pouring end 20 also includes a spouted portion 75 having a central axis (not shown) positioned angularly to a central axis (not shown) of the engaging portion 30, thus resulting in the spouted portion 75 being positioned at an angle with respect to the engaging portion 30. This relationship permits for easier, and more efficient pouring out of the barrel 12. Various features of shape are also contemplated which can result in a narrower or wider stream of liquid being poured, and such features are known in the art of paint pouring spouts.

In order to facilitate insertion of the device 10 in the opening 14 of the barrel 12, the pouring end 20 includes a gripping portion, in the form of a gripping hole 85 formed at a portion of the pouring end 20 distal from the spouted portion 75. The gripping hole 85 is configured to receive a human finger therein, such that the device 10 can be compressed slightly for insertion into and removal from the barrel 12. The gripping hole 85 allows a user to form a tight, but flexible grip on the device 10, and to securely maneuver the device 10 into and out of its friction fit with the barrel 12. It would also be desirable to prevent liquid or paint from contacting the gripping hole 85, or areas immediately adjacent the gripping hole 85 so as to avoid getting liquid onto the hands of the user. One way of accomplishing this is illustrated in the preferred embodiment, where a guard portion 90 extends from an interior surface of the hollow body 15 to a position proximate a top surface 95 of the pouring end 20 surrounding the gripping hole 85. The guard portion 90 thus prevents liquid from contacting the region surrounding where the user's finger would normally engage the device 10. The guard 90 preferably consists of a convex, extruded portion extending from the interior surface of the hollow body 15 proximate the engaging portion 30 to a location proximate the top 95 of the device 10. The guard 90 extends at an angle to the interior surface, and preferably at an angle between 15 and 30 degrees.

Other forms and configurations for preventing liquid from contacting the gripping hole, or any other feature of the device with which a user interacts are also contemplated. For example, the guard may not be convex shaped, or may be entirely enclosed such that a gripping pocket is formed.

The invention herein described has been conceived for use with paint barrels, and in particular standard 5 gallon paint barrels. However, other liquid barrels or barrels of different sizes may also benefit from the combined spout and filter of the invention. The device is preferably made from a semi-rigid material which can be sufficiently flexed using only manual forces to form the friction fit in the opening of the barrel.

Other variations are also contemplated, including varying the number and size of the perforations. The perforations as illustrated in the drawings are enlarged for illustrative purposes only, however, the particular arrangement and configuration of the perforations as herein described has been found to be advantageous and preferred.

It is also contemplated that the engaging portion could itself be threaded so as to better accommodate barrels with threaded openings. However, for more wider applicability and generic application, it is preferred that the friction fit herein described be used.

While a preferred embodiment has been illustrated and described, the scope of the claims should not be limited by these preferred embodiments, but should be given the broadest interpretation consistent with the description as a whole.

The invention claimed is:

1. A combined filter and spout device for use with a barrel having a liquid dispensing opening comprising:

a hollow body having a pouring end, a straining end and a barrel opening engaging portion therebetween;

said engaging portion sized and otherwise dimensioned to be friction fit into the liquid dispensing opening of the barrel;

said pouring end having a shape which facilitates the outflow of liquid from the barrel;

said straining end having a convex surface enclosing said hollow body; said convex surface having a plurality of perforations sized and otherwise dimensioned to permit liquid to pass therethrough;

said hollow body comprising a twisted shape including exterior surface revolutions between said engaging portion and said straining end, the surface revolutions acting to induce a cyclone effect when a liquid is poured out of the barrel; and a plurality of sidewall perforations traversing at least a portion of said exterior surface revolutions to further facilitate the cyclone effect by permitting entry of the liquid into the hollow body portion;

wherein the sidewall perforations are arranged along the surface revolutions to minimize the effects of blockages due to abnormally large solid particles;

and wherein the cyclone effect serves to dislodge the solid particles blocking some of the sidewall perforations.

2. The device according to claim 1, wherein proximate said straining end consists of a distance equivalent to the distance from a bottom end straining end to an apex of said convex surface.

3. The device according to claim 1, wherein said exterior surface revolutions comprise between 0.5 and 2 revolutions.

4. The device according to claim 1, further comprising a plurality of perforations on a bottom portion of one of said exterior surface revolutions proximate said straining end.

5. The device according to claim 1, wherein said pouring end has a diameter greater than a diameter of said engaging portion.

6. The device according to claim 5, wherein said pouring end includes a spouted portion having a central axis positioned angularly to a central axis of said engaging portion, whereby said spouted portion is angled with respect to said engaging portion.

7. The device according to claim 6, wherein said pouring end further comprises a gripping hole formed at a portion of said pouring end distal from said spouted portion; said gripping hole configured to receive a human finger such that the device can be compressed for removal from or insertion into the barrel.

8. The device according to claim 7, further comprising a guard portion extending from an interior surface of said hollow body to a position proximate a top surface of said pouring end surrounding said gripping hole; said guard portion preventing liquid from contacting said gripping hole when liquid is being poured out of the barrel.

9. The device according to claim 8, wherein said guard portion consists of a convex extrusion extending from the interior surface of said hollow body proximate said engaging portion and extending at an angle to said interior surface.

10. The device according to claim 1, wherein the liquid is paint.

11. The device according to claim 10, wherein the barrel is a five galleon paint barrel.

12. The device according to claim 1, wherein the device is formed from a semi-flexible material.

13. A paint barrel comprising;

a main body portion for holding paint;

a paint outlet on a lid of said barrel; and, a combined filter and spout device according to claim 1 positioned in said paint outlet.

14. The paint barrel according to claim 10; wherein said paint barrel is a five galleon barrel.

* * * * *